US010096243B2

(12) United States Patent
Schuermeier

(10) Patent No.: US 10,096,243 B2
(45) Date of Patent: Oct. 9, 2018

(54) COMMUNICATION DEVICE FOR A MOTOR VEHICLE, MOTOR VEHICLE, AND COMMUNICATION METHOD

(71) Applicant: CONTINENTAL AUTOMOTIVE GMBH, Hannover (DE)

(72) Inventor: Martin Schuermeier, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 2 days.

(21) Appl. No.: 15/088,839

(22) Filed: Apr. 1, 2016

(65) Prior Publication Data

US 2016/0293009 A1 Oct. 6, 2016

(30) Foreign Application Priority Data

Apr. 1, 2015 (DE) ..... 10 2015 205 924

(51) Int. Cl.

| | |
|---|---|
| ***G08G 1/0967*** | (2006.01) |
| ***G08G 1/16*** | (2006.01) |
| ***H01Q 1/32*** | (2006.01) |
| ***H01Q 21/20*** | (2006.01) |

(52) U.S. Cl.

CPC . *G08G 1/096758* (2013.01); *G08G 1/096791* (2013.01); *G08G 1/162* (2013.01); *H01Q 1/3275* (2013.01); *H01Q 21/205* (2013.01)

(58) Field of Classification Search

CPC ..... G08G 1/161; G08G 1/1004

See application file for complete search history.

(56) References Cited

U.S. PATENT DOCUMENTS

| | | | | |
|---|---|---|---|---|
| 6,876,642 | B1 * | 4/2005 | Adams | H04W 84/12 307/10.1 |
| 8,280,583 | B2 | 10/2012 | Stählin et al. | |
| 2008/0004777 | A1 | 1/2008 | Quigley | |
| 2008/0238636 | A1 * | 10/2008 | Birging | B60R 25/1004 340/426.1 |
| 2010/0313017 | A1 * | 12/2010 | Stahlin | B60W 40/12 713/168 |
| 2010/0324756 | A1 * | 12/2010 | Fletcher | G05B 19/0421 701/3 |
| 2012/0134506 | A1 * | 5/2012 | DeBiasio | H04B 1/082 381/86 |
| 2012/0154173 | A1 * | 6/2012 | Chang | G01S 7/032 340/904 |
| 2012/0255982 | A1 * | 10/2012 | Craig | B60R 11/0258 224/483 |

(Continued)

FOREIGN PATENT DOCUMENTS

| | | | |
|---|---|---|---|
| CN | 101896953 | A | 11/2010 |
| CN | 102986256 | A | 3/2013 |

(Continued)

*Primary Examiner* — Hoi Lau

(74) *Attorney, Agent, or Firm* — Laurence A. Greenberg; Werner H. Stemer; Ralph E. Locher

(57) ABSTRACT

A communication device for a motor vehicle has a plurality, but preferably two, communication modules that are configured in each case to communicate wirelessly with other motor vehicles and wirelessly with one another. A motor vehicle is equipped with a communication device of this type, and a method for communication between a plurality of motor vehicles is carried out.

19 Claims, 2 Drawing Sheets

(56) References Cited

U.S. PATENT DOCUMENTS

| | | | | |
|---|---|---|---|---|
| 2013/0065534 | A1* | 3/2013 | Nejad | H04W 4/046 455/66.1 |
| 2013/0103781 | A1 | 4/2013 | Mori et al. | |
| 2013/0154853 | A1* | 6/2013 | Chen | G08G 1/096716 340/905 |
| 2013/0191132 | A1* | 7/2013 | Tanaka | G10L 21/06 704/275 |
| 2014/0156111 | A1* | 6/2014 | Ehrman | G06Q 30/0645 701/2 |

FOREIGN PATENT DOCUMENTS

| | | | |
|---|---|---|---|
| CN | 104071189 | A | 10/2014 |
| DE | 102008008229 | A1 | 8/2009 |
| DE | 102009054776 | A1 | 8/2010 |
| DE | 102010029465 | A1 | 12/2011 |
| EP | 1627778 | A1 | 2/2006 |
| JP | 2006025028 | A | 1/2006 |
| JP | 2008172534 | A | 7/2008 |
| JP | 2009048547 | A | 3/2009 |

* cited by examiner

COMMUNICATION DEVICE FOR A MOTOR VEHICLE, MOTOR VEHICLE, AND COMMUNICATION METHOD

CROSS-REFERENCE TO RELATED APPLICATION

This application claims the priority, under 35 U.S.C. § 119, of German patent application DE 10 2015 205 924.3, filed Apr. 1, 2015; the prior application is herewith incorporated by reference in its entirety.

BACKGROUND OF THE INVENTION

Field of the Invention

The invention relates to a communication device for a motor vehicle by way of which the motor vehicle can communicate with other motor vehicles.

Motor vehicles are equipped with communication devices of this type in order to implement an autonomous communication between a plurality of motor vehicles. Communication between the motor vehicles participating in road traffic can result in a considerable increase in road safety.

This can be done, for example, by assisting the vehicle driver in driving the vehicle on the basis of information from the communication with other motor vehicles. Warning signals or traffic information can thus be displayed to the vehicle driver and can be taken into account by the latter in driving the motor vehicle.

Road safety can furthermore be increased through the intervention in the vehicle driving by a collision avoidance system on the basis of information from the communication with other motor vehicles, and through the initiation, for example, of emergency braking.

Particularly in the case of traffic hazards which are not perceptible to the vehicle driver at an early stage, an information exchange between a plurality of motor vehicles can result in an accident avoidance. A traffic hazard of this type is represented, inter alia, by a concealed end of a tailback around a bend, for example a freeway entrance or exit. A multiplicity of traffic hazards of this type exist in urban traffic also, particularly in the vicinity of blind intersections or winding narrow roads.

However, a maximum number of communication-enabled motor vehicles is required in order to be able to increase road safety effectively with the described vehicle-to-vehicle communication. The fitting of new vehicles with suitable communication devices during production must be deemed to be inadequate given that the proportion of communication-enabled motor vehicles would increase extremely slowly in this case. However, currently known communication devices are not readily suitable for retrofitting.

Antennas of known communication modules have to be positioned on the vehicle roof due to the need for a 360-degree radio radius which is as unimpeded as possible. Considerable expense would consequently have to be incurred in retrofitting a communication unit of this type. Retrofits of this type require, inter alia, corresponding holes to be made in the vehicle roof in order to attach the antenna and provide a cable route for the antenna cable. Furthermore, a roof antenna of this type can adversely affect the visual appearance of the motor vehicle.

SUMMARY OF THE INVENTION

It is accordingly an object of the invention to provide a communication device for a motor vehicle which overcomes the above-mentioned and other disadvantages of the heretofore-known devices of this general type and which provides for retrofitting communication devices for vehicle-to-vehicle communication at low cost.

With the foregoing and other objects in view there is provided, in accordance with the invention, a communication device for a motor vehicle, comprising:

a plurality of communication modules to be mounted to the motor vehicle and each configured to communicate wirelessly with other motor vehicles and to communicate wirelessly with one another.

In other words, the communication device according to the invention with a plurality of, preferably two, communication modules communicating wirelessly with one another, removes the need for a single communication module to cover the 360-degree radio radius required for reliable communication with the other motor vehicles. Due to the presence of a plurality of communication modules which are configured in each case to communicate wirelessly with other vehicles and wirelessly with one another, a single communication module is complemented by means of one or more other communication modules. This makes it possible for a communication module to be disposed also at a position in or on the motor vehicle which does not allow the communication module a 360-degree radio radius for communicating with other motor vehicles. This is the case at positions where the radio signal is impeded or corrupted by vehicle components, such as, for example, a body panel. The radio area not covered by the communication module is covered in the communication device according to the invention by a further communication module which is disposed at a different position in the motor vehicle. The communication device according to the invention can consequently be disposed in the passenger compartment also, since any radio impediments affecting individual communication modules can be compensated by one or more other communication modules. The communication device according to the invention can thus be retrofitted at low cost.

In a first preferred embodiment of the communication device according to the invention, at least one, preferably each, communication module comprises a transmit unit for transmitting data to other motor vehicles. Information can thus be made available to the other motor vehicles also. This information may not only be data which relate to the vehicle state or the vehicle driving of the motor vehicle in which the communication device according to the invention is installed, but also data which relate to the vehicle state or the vehicle driving of other motor vehicles and which are made available by other motor vehicles, via the communication device according to the invention, to the motor vehicle in which the communication device according to the invention is installed. Data, for example, relating to the vehicle position, the vehicle speed, the direction of travel, the vehicle acceleration, the steering angle, the state of assistance systems such as ABS or ESP or variations with time or histories of these data can be transmitted via the transmit unit to other motor vehicles. The transmit unit is preferably configured to transmit the data via WLAN or mobile radio, in particular via UMTS or LTE, or at a frequency of 5.9 GHz or 700 MHz.

In particular, at least one, preferably each, communication module is configured to transmit signals at a limited beam angle only. The term limited beam angle means less than full 360° coverage, or about 200°, or at least 180° (for two modules), or at least 90° (for four modules), etc. This comprises both the limitation of the transmit angle by means of suitable control software and the limitation of the transmit angle due to the structural design of the hardware that is used, such as, for example, the use of an antenna which, rather than having an omnidirectional characteristic, allows a transmission of data at a limited angle only.

In a second embodiment of the communication device according to the invention, at least one, preferably each, communication module comprises a receive unit for receiving data from other motor vehicles. In this way, data transmitted by other motor vehicles can be taken into account in the early detection of traffic hazards, for example when the data are used by a collision avoidance system or for assisting the vehicle driver in driving the vehicle. Furthermore, the received data can also be stored temporarily and forwarded later in order to make these data available to other motor vehicles. Data, for example, relating to the vehicle position, the vehicle speed, the direction of travel, the vehicle acceleration, the steering angle, the state of assistance systems such as ABS or ESP or variations with time or histories of these data can be transmitted via the receive unit from other motor vehicles. The receive unit is preferably configured to receive the data via WLAN or mobile radio, in particular via UMTS or LTE, or at a frequency of 5.9 GHz or 700 MHz.

In particular, at least one, preferably each, communication module is configured to receive signals from a limited beam angle only. This comprises both the limitation of the receive angle by means of suitable control software and the limitation of the receive angle due to the structural design of the hardware that is used, such as, for example, the use of an antenna which, rather than having an omnidirectional characteristic, allows a reception of data at a limited angle only.

In a further embodiment of the communication device according to the invention, a plurality of communication modules are configured in each case to communicate independently and wirelessly with other motor vehicles and independently and wirelessly directly with one another. Due to the independent communication of the communication modules, the data exchange with other motor vehicles and the data exchange between the communication modules within the vehicle are carried out independently from the vehicle driver, so that the latter can focus his attention on driving the vehicle. However, this does not mean that the vehicle driver cannot control the communication device. It should be understood that, despite the independent communication capability of the communication modules, the vehicle driver can influence the function, particularly in terms of whether the communication device is activated or deactivated, via suitable measures. The independent communication between the communication modules results in the automatic compensation of individual non-covered radio areas of a communication module by one or more other communication modules, and in an overall mutual complementing of the radio areas.

Alternatively or additionally, a plurality of communication modules are configured in each case to communicate independently and wirelessly with one another via an on-board power supply system. In this way, the data communicated within the vehicle can be picked up and used by further systems. The time delay in the data processing and evaluation is thus reduced, as a result of which, for example, an emergency braking can be initiated earlier.

The communication device according to the invention is furthermore advantageously developed by configuring at least two communication modules to exchange data bidirectionally with one another. Due to the bidirectional data exchange, the communication modules interact as one functional unit. Two or more communication modules disposed at different positions on or in the motor vehicle and limited in their radio coverage area can act in a manner identical or at least similar to one communication module with a 360-degree radio radius.

In one advantageous embodiment of the communication device according to the invention, at least two communication modules in each case have a separate radio unit for exchanging data wirelessly with one another. By means of the separate radio unit, the communication with other motor vehicles is structurally and functionally separated from the internal communication between the individual communication modules. Thus, for example, the communication with other motor vehicles can take place at a frequency different from that of the internal communication between the individual communication modules.

In one particularly preferred embodiment of the communication device according to the invention, each communication module has its own module housing. The respective module housings are preferably made from plastic. As a result of the communication modules in each case having their own module housing, the retrofitting of the communication device according to the invention is further simplified, since the individual module housings must simply be disposed in each case at a suitable position on or in the motor vehicle and attached in a suitable manner.

In a further advantageous development, the communication device according to the invention is characterized in that at least one communication module has an interface for connecting to a data transmission network, in particular a bus system of a motor vehicle. By means of an interface of this type, the communication device according to the invention can be integrated into the data processing system within the vehicle without great expense. Thus, on the one hand, the data received from other motor vehicles can be used by further devices of the motor vehicle which are connected to the data transmission network and, on the other hand, the communication device according to the invention can transmit data which are made available to it by the data transmission network to other motor vehicles.

In a further embodiment of the communication device according to the invention, at least one communication module has a man-machine interface. The man-machine interface allows the communication with the vehicle driver. Traffic-related information, for example, which is generated through the evaluation of data received from other motor vehicles can thus be made available to the vehicle driver. Similarly, the data of the motor vehicle in which the communication device according to the invention is installed can preferably be evaluated so that traffic-related information can be made available to the vehicle driver on the basis of these data also. Not only data of the motor vehicle in which the communication device according to the invention is installed, but also data which are received from other motor vehicles are therefore taken into account. The man-machine interface is preferably a display unit for the visual reproduction of information. This may, for example, be a display or a visually perceptible warning signal, such as, for example, a warning light. Alternatively or additionally, the man-machine interface preferably comprises a sound reproduction device, such as, for example, a loudspeaker. By means of a sound reproduction device, information can be made available to the vehicle driver without him having to take his eyes off the road. The assimilation of the supplied information thus requires only a small amount of attention on the part of the vehicle driver, so that he can continue to concentrate on driving the vehicle. The man-machine interface may, for example, be connected to the bus system of a motor vehicle. In this case, the man-machine interface has preferably already been integrated into the motor vehicle during production and is, for example, part of the audio or display system of the motor vehicle. The man-machine interface may furthermore also be a separate, in particular retrofittable, component which is not connected to the bus system of the motor vehicle. This results in a further simplification of the subsequent integration of the communication device according to the invention into a motor vehicle.

The man-machine interface is preferably configured to assist the vehicle driver in driving the vehicle. This is preferably done by providing the vehicle driver with traffic-related information in such a timely manner that he can take this information into account in driving the vehicle. This may, for example, be a warning relating to a concealed end of a tailback or a slippery road surface due to weather conditions. The assistance preferably also comprises an intervention in the vehicle driving, for example through the initiation of an emergency braking to avoid a collision or to reduce the impact of a collision that is no longer avoidable.

The communication device according to the invention is furthermore advantageously developed in that one, preferably each, communication module has a storage unit for electrical energy which is configured to provide sufficient electrical power, at least temporarily, for the operation of the communication module or the communication device. The communication device can be powered autonomously by means of a storage unit for electrical energy of this type so that its operation is not dependent on a connection to an external power supply. The retrofittability is thus further increased, since the cost of integrating and installing the communication device according to the invention is further reduced.

In one particularly preferred embodiment of the communication device according to the invention, at least one, preferably each, communication module has attachment means for attaching the communication module to the motor vehicle. The attachment means are preferably designed to attach the communication module to a front windshield, a rear window, a dashboard, a roof lining, a rearview mirror, a section of the interior lining or a rear parcel shelf of a motor vehicle. An attachment of this type may be achieved, for example, via adhesive holding surfaces, suction devices, clamping mechanisms and/or magnets. Furthermore, a screw fitting of the communication modules is also conceivable.

With the above and other objects in view there is also provided, in accordance with the invention, a motor vehicle that is equipped with the communication device as outlined above. The motor vehicle according to the invention has a communication device of which a plurality of, preferably two, communication modules, are disposed at a distance from one another on or in the motor vehicle. With regard to the advantages of the motor vehicle according to the invention, reference is made to the advantages of the communication device according to the invention.

In a first embodiment of the motor vehicle according to the invention, a first communication module is configured to communicate with other motor vehicles located in the direction of travel, and a second communication module is configured to communicate with other motor vehicles located opposite the direction of travel. The first communication module is preferably disposed in the direction of travel of the motor vehicle in front of the second communication module. For example, the first communication module is disposed on the front windshield, the rearview mirror or the dashboard of the motor vehicle, while the second communication module is disposed on the rear window or the rear parcel shelf of the motor vehicle. The first communication module and the second communication module complement one another and compensate in each case for the radio area of the other communication module that is not covered. Both the first and the second communication modules are preferably configured to communicate with other motor vehicles which are located to the side of the motor vehicle.

In a second embodiment of the motor vehicle according to the invention, the communication modules in each case have a limited transmit and/or receive radius and the communication modules are disposed and designed in such a way that the transmit and/or receive radii of all communication modules together form an omnidirectional characteristic. The communication modules thus interwork functionally in such a way that they can replace any one module with a 360-degree radio radius.

It is furthermore preferred that the motor vehicle according to the invention has an on-board power supply system, wherein at least one communication module is connected to the on-board power supply system of the motor vehicle.

The object on which the invention is based is similarly achieved by the method of claim 15. In the method according to the invention for communication between a plurality of motor vehicles, at least one motor vehicle communicates with other motor vehicles by means of a communication device according to one of the embodiments described above. The motor vehicle is preferably designed according to an embodiment described above. With regard to the advantages of the method according to the invention, reference is made to the advantages of the communication device according to the invention and the advantages of the motor vehicle according to the invention.

Other features which are considered as characteristic for the invention are set forth in the appended claims.

Although the invention is illustrated and described herein as embodied in a communication device for a motor vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
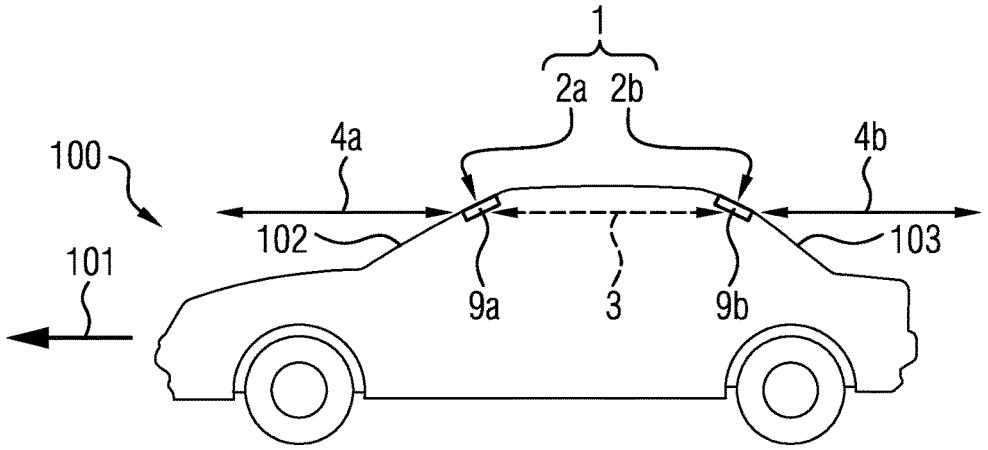
FIG. 1 shows an embodiment of the motor vehicle according to the invention with a communication device according to the invention in a schematic cross-sectional view.

Referring now to the figures of the drawing in detail and first, particularly, to FIG. 1 thereof, there is shown the motor vehicle 100 which has a communication device 1 according to the invention. The communication device 1 comprises two communication modules 2*a*, 2*b* which are disposed at a distance from one another and are configured in each case to communicate independently and wirelessly with other motor vehicles via signals 4*a*, 4*b*. The communication modules 2*a*, 2*b* are furthermore configured to communicate with one another independently and wirelessly via signals 3. The data exchange between the communication modules 2*a*, 2*b* is performed bidirectionally.

Each of the communication modules 2*a*, 2*b* has its own module housing 9*a*, 9*b* via which it is attached in each case to the motor vehicle 100. The first communication module 2*a* is attached to the front windshield 102 of the motor vehicle 100 and is configured to communicate with other motor vehicles located in the direction of travel 101. The second communication module 2*b* is attached to the rear window 103 of the motor vehicle 100 and is configured to communicate with other motor vehicles located opposite the direction of travel 101. Both communication modules 2*a*, 2*b* are configured to communicate with other motor vehicles that are positioned laterally.

Figure 2:
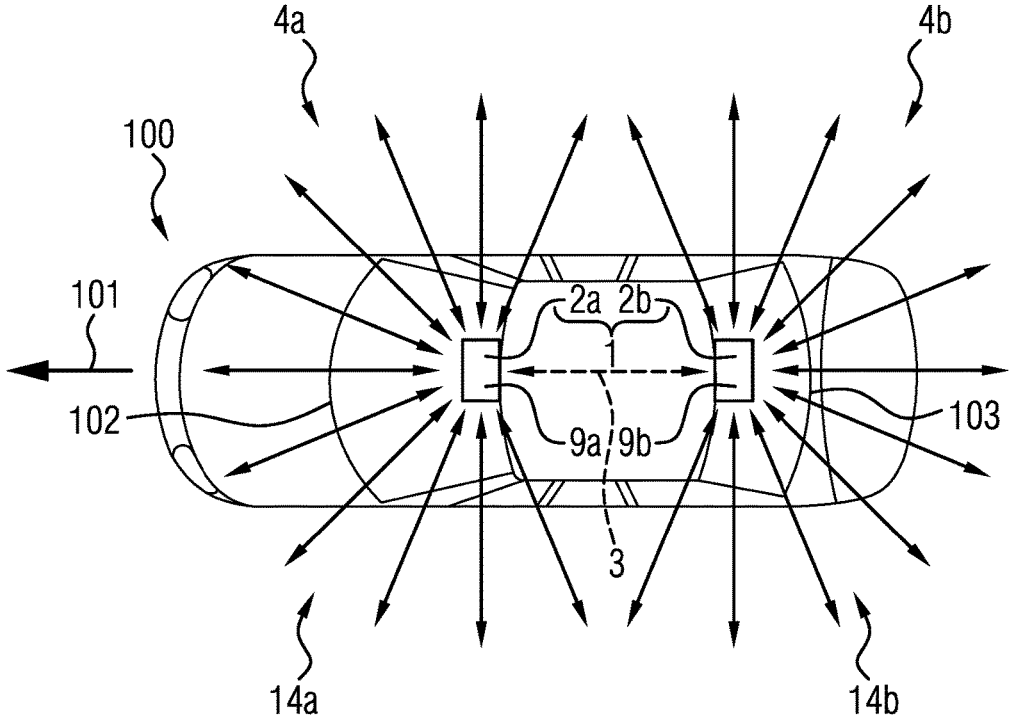
FIG. 2 shows the embodiment of the motor vehicle according to the invention from FIG. 1 in a schematic top view.

As shown in FIG. 2, the communication modules 2*a*, 2*b* in each case have a limited transmit and receive radius 14*a*, 14*b*. However, the respective limited transmit and receive radii of the communication modules 2*a*, 2*b* are designed in such a way and the communication modules 2*a*, 2*b* are disposed within the motor vehicle 100 in such a way that the transmit and receive radii 14*a*, 14*b* of both communication modules 2*a*, 2*b* together form an omnidirectional characteristic, substantially without any blind spot. Both communication modules 2*a*, 2*b* are consequently configured to transmit signals 4*a*, 4*b* at a limited beam angle only and to receive signals 4*a*, 4*b* from a limited angle of incidence only.

Figure 3:
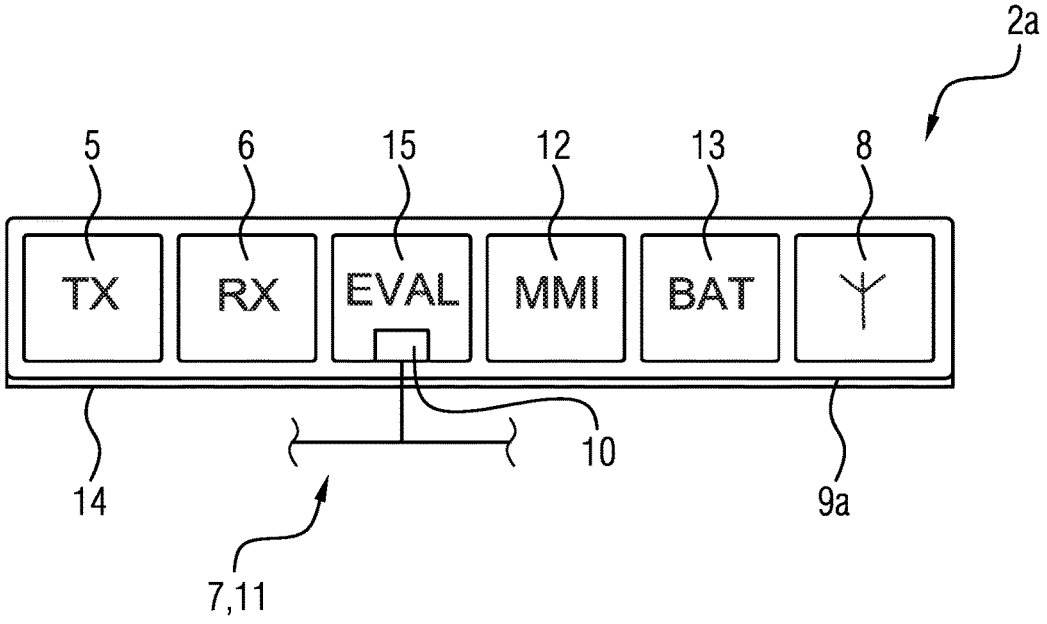
FIG. 3 shows an embodiment of a communication module of the communication device according to the invention.

The communication module 2*a* shown in FIG. 3 has a transmit unit (TX) 5 by means of which data can be transmitted to other motor vehicles. The communication module 2*a* furthermore has a receive unit (RX) 6 by means of which data can be received from other motor vehicles. The processing and evaluation unit (EVAL) 15 of the communication module 2*a* has an interface 10 for connection to an on-board power supply system 7 or a data transmission network 11. The data transmission network 11 may, for example, be a bus system of a motor vehicle. The communication module 2*a* furthermore comprises a man-machine interface (MMI) 12 which is configured to assist a vehicle driver in driving the vehicle, and also a storage unit (BAT) for electrical energy 13 which is configured to provide, at least temporarily, sufficient electrical power for the operation of the communication module 2*a*. The man-machine interface 12 comprises a display unit for the visual reproduction of information, and a sound reproduction device. In order to be able to exchange data wirelessly with a further communication module (not shown), the illustrated communication module 2*a* has a separate radio unit 8. Attachment means 14 for attaching the communication module 2*a* to a motor vehicle are disposed on the module housing 9*a* of the communication module 2*a*.

The following is a summary list of reference numerals and the corresponding structure used in the above description of the invention:

1 Communication device
2*a*/2*b* Communication modules
3 Signals for communication between the communication modules
4*a*, 4*b* Signals for communication with other motor vehicles
5 Transmit unit
6 Receive unit
7 On-board power supply system
8 Radio unit
9*a*, 9*b* Module housing
10 Interface
11 Data transmission network
12 Man-machine interface
13 Storage unit for electrical energy
14*a*, 14*b* Transmit and/or receive radius
15 Processing and evaluation unit
100 Motor vehicle
101 Direction of travel
102 Front windshield
103 Rear window

The invention claimed is:

1. A communication device for a motor vehicle, comprising:

a plurality of communication modules mounted to the motor vehicle and each configured to communicate wirelessly with other motor vehicles, each one of said plurality of communication modules configured to directly communicate wirelessly with one another;

at least two said communication modules configured to wirelessly exchange data bidirectionally with one another.

2. The communication device according to claim 1, wherein said plurality of communication modules is exactly two communication modules mounted to the motor vehicle.

3. The communication device according to claim 1, wherein at least one of said communication modules comprises a transmit unit for transmitting data to other motor vehicles, and said at least one communication module is configured to transmit signals at a limited beam angle only.

4. The communication device according to claim 1, wherein each said communication module comprises a transmit unit for transmitting data to other motor vehicles, and wherein each said communication module is configured to transmit signals at a limited beam angle only.

5. The communication device according to claim 1, wherein at least one of said communication modules comprises a receive unit for receiving data from other motor vehicles, and said at least one communication module is configured to receive signals from a limited beam angle only.

6. The communication device according to claim 1, wherein each said communication module comprises a receive unit for receiving data from other motor vehicles, and wherein each said communication module is configured to receive signals from a limited beam angle only.

7. The communication device according to claim 1, wherein a plurality of said communication modules are configured in each case to communicate independently and wirelessly with other motor vehicles and independently and wirelessly directly with one another and/or independently with one another via an on-board power supply system.

8. The communication device according to claim 1, wherein each of said at least two communication modules has a separate radio unit in order to exchange data wirelessly with the respectively other communication module.

9. The communication device according to claim 1, wherein each said communication module has a dedicated module housing.

10. The communication device according to claim 1, wherein at least one of said communication modules has an interface for connection to a data transmission network.

11. The communication device according to claim 10, wherein the data transmission network is a bus system of a motor vehicle.

12. The communication device according to claim 1, wherein at least one of said communication modules has a man-machine interface configured to assist a vehicle driver in driving the vehicle.

13. The communication device according to claim 1, wherein at least one of said communication modules has a storage unit for electrical energy which is configured to provide sufficient electrical power, at least temporarily, for an operation of said at least one communication module or the communication device.

14. The communication device according to claim 13, wherein each one of said plurality of communication modules has a storage unit for electrical energy.

15. The communication device according to claim 1, wherein each one of said plurality of communication modules includes an attachment device for attaching the communication module to the motor vehicle.

16. A motor vehicle, comprising a communication device according to claim 1 with at least two communication modules disposed at a spacing distance from one another on or in the motor vehicle.

17. The motor vehicle according to claim 16, wherein a first communication module is configured to communicate with other motor vehicles located in a direction of travel, and a second communication module is configured to communicate with other motor vehicles located opposite the direction of travel.

18. The motor vehicle according to claim 16, wherein each of the communication modules has a limited transmit and/or receive radius and the communication modules are disposed and configured such that a common transmit and/or receive radius of all communication modules together forms an omnidirectional characteristic.

19. A method for communication between a plurality of motor vehicles, the method which comprises:

providing a motor vehicle with a communication device according to claim 1; and causing the motor vehicle to communicate with other motor vehicles by way of the communication device.

* * * * *